US009636718B2

(12) United States Patent
Chiang et al.

(10) Patent No.: US 9,636,718 B2
(45) Date of Patent: May 2, 2017

(54) MASK CLEANING APPARATUS AND MASK CLEANING METHOD

(71) Applicant: BOE TECHNOLOGY GROUP CO., LTD., Beijing (CN)

(72) Inventors: Kelvin Chiang, Beijing (CN); Peng Zhang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 14/904,221

(22) PCT Filed: Apr. 24, 2015

(86) PCT No.: PCT/CN2015/077368
§ 371 (c)(1),
(2) Date: Jan. 11, 2016

(87) PCT Pub. No.: WO2016/101462
PCT Pub. Date: Jun. 30, 2016

(65) Prior Publication Data

US 2016/0214149 A1 Jul. 28, 2016

(30) Foreign Application Priority Data

Dec. 24, 2014 (CN) ..... 2014 1 0817986

(51) Int. Cl.
*B08B 7/00* (2006.01)
*B08B 7/02* (2006.01)
(Continued)

(52) U.S. Cl.
CPC ..... *B08B 7/0021* (2013.01); *B08B 7/028* (2013.01); *B24C 1/00* (2013.01); *B24C 1/003* (2013.01); *B24C 1/086* (2013.01); *B24C 3/32* (2013.01)

(58) Field of Classification Search
CPC ..... B08B 7/0021; B08B 7/028; B24C 1/00
(Continued)

(56) References Cited

U.S. PATENT DOCUMENTS

2009/0098309 A1 4/2009 Brody et al.
2011/0265815 A1 11/2011 Mitake et al.
2012/0247504 A1* 10/2012 Nasr ..... B08B 7/0035 134/1.1

FOREIGN PATENT DOCUMENTS

CN 2443788 Y 8/2001
CN 1822905 A 8/2006
(Continued)

OTHER PUBLICATIONS

Second Chinese Office Action mailed Aug. 2, 2016.
(Continued)

*Primary Examiner* — Duy Deo
*Assistant Examiner* — Maki Angadi
(74) *Attorney, Agent, or Firm* — Dilworth & Barrese, LLP.; Michael J. Musella

(57) ABSTRACT

A mask cleaning apparatus and a mask cleaning method are provided. The mask cleaning method comprises: placing a mask (100) on a stage (20); and ejecting a dry ice particle group including a plurality of dry ice particles (101) toward a surface of the mask (100) at a speed of 340 m/s to 1000 m/s, within a cleaning time, wherein the plurality of dry ice particles (101) impact the surface of the mask (100) so as to remove a contaminant on the surface of the mask. Thereby, the mask cleaning apparatus and the mask cleaning method provided by embodiments of the present disclosure can remove the contaminant on the mask, without increasing a contamination medium and damaging the surface of the mask.

20 Claims, 2 Drawing Sheets

(51) Int. Cl.

| | |
|---|---|
| ***B24C 1/00*** | (2006.01) |
| ***B24C 1/08*** | (2006.01) |
| ***B24C 3/32*** | (2006.01) |

(58) Field of Classification Search
USPC ..... 134/1.1, 7, 18, 22.18; 510/407, 418; 451/40
See application file for complete search history.

(56) References Cited

FOREIGN PATENT DOCUMENTS

| | | | |
|---|---|---|---|
| CN | 101011814 | A | 8/2007 |
| CN | 101081395 | A | 12/2007 |
| CN | 100403556 | C | 7/2008 |
| CN | 101338410 | A | 1/2009 |
| CN | 102989719 | A | 3/2013 |
| CN | 103157619 | A | 6/2013 |
| CN | 103831263 | A | 6/2014 |
| CN | 104492761 | A | 4/2015 |
| JP | H07256222 | A | 10/1995 |
| JP | H09262545 | A | 10/1997 |
| JP | 2004089944 | A | 3/2004 |
| JP | 2005129299 | A | 5/2005 |

OTHER PUBLICATIONS

Search Report and Written Opinion mailed Oct. 16, 2015 from State Intellectual Property Office of the P.R. China.
Chinese Office Action mailed Feb. 3, 2016.
("Research of dry ice cleaning technoloay", Sun Hongmeng, Databases of the whole text of China's outstanding master's degree thesis (electronic magazine), pp. 8, 12-16, 35-36 and 42-46, Oct. 2012).
"Detailed Description and Photos of OLED Organic Light Emitting Device"; http://www.bolearn.com/read/bdd3c48333ddaeca67f1342a.html.
Third Chinese Office Action mailed Jan. 3, 2017.

* cited by examiner

MASK CLEANING APPARATUS AND MASK CLEANING METHOD

TECHNICAL FIELD

Embodiments of the present disclosure relate to a mask cleaning apparatus and a mask cleaning method.

BACKGROUND

An Organic Light Emitting Diode (OLED) display device, as an active light emitting display device, is increasingly applied to the high-performance display field, due to its characteristics such as self-illumination, fast response, wide viewing angle and ability to be fabricated on a flexible substrate.

In a manufacturing process of the OLED, a patterned thin film layer is formed usually by using a vacuum evaporation process in combination with a mask process. As shown in FIG. 1, by using a mask 100, a red organic light emitting material 11, a green organic light emitting material 12 and a blue organic light emitting material 13 are sequentially evaporated on a surface of a substrate 10 by shifting side by side. In this procedure, a contaminant generated will be adsorbed on the mask 100, and may cause clogging of an opening of the mask 100. Thus, in the above-described shifting procedure, a defect phenomena such as a repetitive defect and uneven filming will be caused.

In the prior art, in order to solve the above-described problem of mask pollution, a mask cleaning method generally used comprises: wet liquid immersion, dry collecting, dry physical adhesion, dry plasma ashing cleaning, and so on. Therein, the dry collecting is to remove the contaminant adhered to a surface of the mask by airflow in a physical air exhaust mode; and the dry physical adhesion is to remove the contaminant adhered to the surface of the mask by using a physical or a chemical sticking board. However, in the above-described modes, it is difficult to clean a tiny and sticky contaminant in a corner or slit, and the cleaning effect thereof is limited. And the dry plasma ashing cleaning is to ash the contaminant on the surface of the mask by using high-energy plasma, and the method is capable of removing an organic contaminant and fine dust, but it is difficult to remove a larger inorganic contaminant; moreover, in an ashing procedure, the surface of the mask is likely to be damaged. In addition, the wet liquid immersion method is to remove the contaminant on the surface of the mask by using organic liquid immersion, but by using this method, liquid is apt to remain in the slit of the mask, to cause corrosion to the mask, and reduce a service life of the mask. In addition, it is further necessary to consume manpower and material resources to regularly perform maintenance on the cleaning apparatus subjected to wet liquid immersion. At the same time, in the procedure of using the method, wasted solution will be generated to pollute environment.

SUMMARY

Embodiments of the present disclosure provide a mask cleaning apparatus and a mask cleaning method, which are capable of removing a contaminant on the mask, without increasing a contamination medium and damaging a surface of the mask.

In one aspect, an embodiment of the present disclosure provides a mask cleaning method, comprising: placing the mask on a stage; and ejecting a dry ice particle group including a plurality of dry ice particles toward a surface of the mask at a speed of 340 m/s to 1000 m/s, within a cleaning time, wherein the plurality of dry ice particles impact the surface of the mask so as to remove a contaminant on the surface of the mask.

In the other aspect, an embodiment of the present disclosure provides a mask cleaning apparatus, comprising: a chamber, configured to accommodate the mask; and a dry ice ejecting device, configured to eject a dry ice particle group including a plurality of dry ice particles toward the mask at a speed of 340 m/s to 1000 m/s, the dry ice particles impacting on the surface of the mask so as to remove a contaminant on the surface of the mask.

BRIEF DESCRIPTION OF THE DRAWINGS

In order to clearly illustrate the technical solution of the embodiments of the present disclosure, the drawings of the embodiments will be briefly described in the following; it is obvious that the described drawings are only related to some embodiments of the present disclosure and thus are not limitative of the present disclosure.

DETAILED DESCRIPTION

In order to make objects, technical details and advantages of the embodiments of the present disclosure apparent, the technical solutions of the embodiment will be described in a clearly and fully understandable way in connection with the drawings related to the embodiments of the present disclosure. It is obvious that the described embodiments are just a part but not all of the embodiments of the present disclosure. Based on the described embodiments of the present disclosure, those ordinarily skilled in the art can obtain other embodiment(s), without any inventive work, which should be within the protective scope of the present disclosure.

Figure 1:
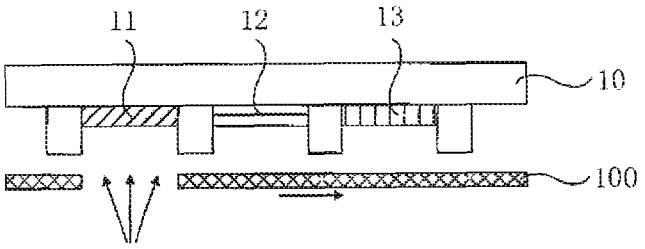
FIG. 1 is a schematic diagram of a fabrication process of an OLED in the prior art.
Figure 2:
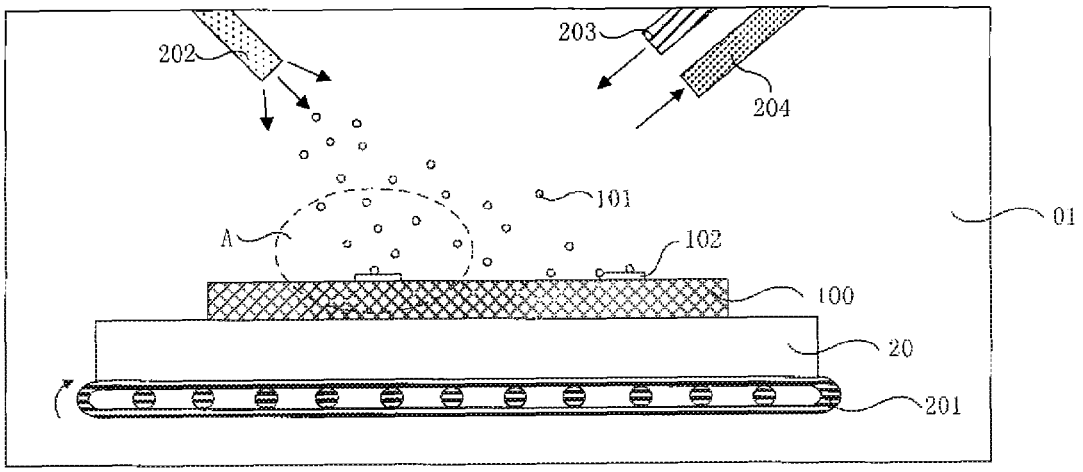
FIG. 2 is a schematic diagram of a mask cleaning process provided by an embodiment of the present disclosure.

An embodiment of the present disclosure provides a mask cleaning method, which, as shown in FIG. 2, may comprise:

Ejecting a dry ice particle group (mainly including dry ice particles 101 of a high density) toward a surface of the mask 100 at an ejecting speed of 340 m/s to 1000 m/s, within a cleaning time T, the dry ice particles 101 in the dry ice particle group impacting on the surface of the mask 100 so as to remove a contaminant on the surface of the mask, wherein, the above-described ejecting speed includes end values 340 m/s and 1000 m/s. On the one hand, when the ejecting speed of the dry ice particles 101 is less than 340 m/s, since an impact strength is too small, a strength impacting on a contaminant 102 is weak, and after a crack appears in the contaminant 102, the dry ice particles 101 just entering the crack may sublimate into gas, unable to apply an acting force to the crack to enlarge it, so that the contaminant 102 cannot be removed. On the other hand, when the speed is greater than 1000 m/s, although the impact strength on the contaminant 102 is increased, yet at the same time it will also cause damage to the mask 100. For example, for a mask 100 made of an iron-nickel alloy, when a contaminant adhered to the surface thereof is an organic contaminant, and when the ejecting speed of the dry ice particle group is 340 m/s to 1000 m/s, the above-described contaminant can be effectively removed.

Figure 3A:
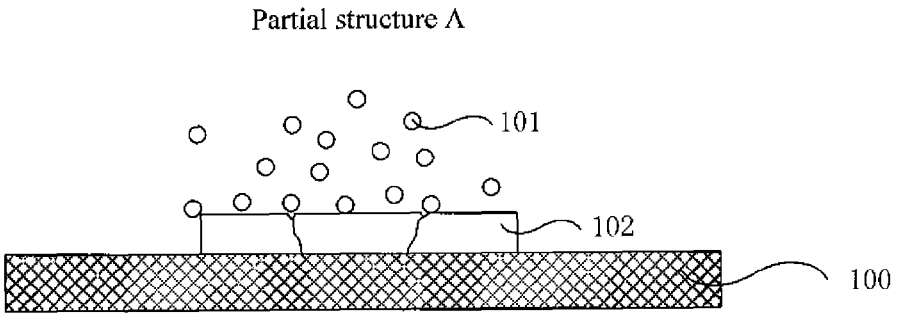
FIG. 3*a* to FIG. 3*c* are a schematic diagram of a partial structure A at respective stages in the mask cleaning process provided by an embodiment of the present disclosure.
Figure 3B:
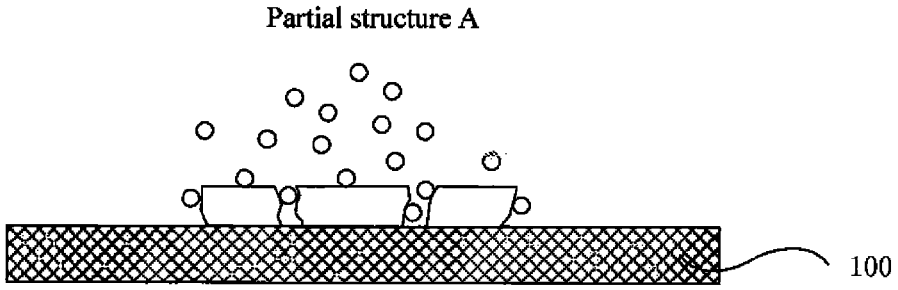
Figure 3C:
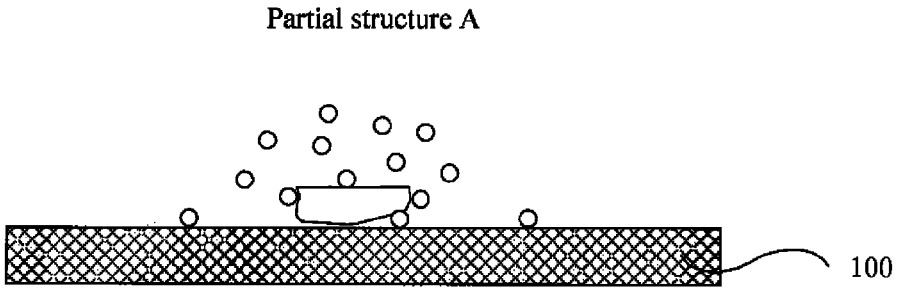

It should be noted that, firstly, an exemplary cleaning process may be that, as shown in FIG. 3*a* (a partial top view at a position A in FIG. 2), under continuous impact of the dry ice particles 101 at a high speed (a speed approaching a sound speed 340 m/s), a surface temperature of the contaminant 102 adhered to the mask 100 is sharply decreased, the surface of the contaminant 102 is embrittled and a crack appears. Next, as shown in FIG. 3*b*, a part of the dry ice particles 101 which subsequently impact the mask enter the above-described crack, enlarge the crack, and reduce adhesion of the contaminant 102; as shown in FIG. 3*c*, other part of the dry ice particles 101 further impact the surface of the contaminant 102, so that the contaminant 102 having a crack finally falls off from the surface of the mask 100, to ultimately achieve an effect of cleaning the mask 100.

Secondly, those skilled in the art may set the cleaning time T and a size of the dry ice particle 101, according to a type of the contaminant adhered to the surface of the mask 100. For example, when the contaminant adhered to the mask 100 is a tiny contaminant, the size of the dry ice particle 101 and the cleaning time T may be reduced. When the contaminant 102 has a larger volume and greater stickiness, a volume of the dry ice particle 101 and the cleaning time T may be increased.

Exemplarily, a particle size of the dry ice particle 101 may be 1 μm to 100 μm. On the one hand, when the particle size of the dry ice particle 101 is less than 1 μm, a strength impacting on the contaminant 102 is weak, and an effect of removing the contaminant is not ideal. On the other hand, when the particle size of the dry ice particle 101 is greater than 100 μm, although the strength impacting on the contaminant 102 is increased, yet an effect of removing the contaminant in a slit is not ideal.

An embodiment of the present disclosure provides a mask cleaning method, comprising: placing a mask on a loading surface of a stage, then ejecting a dry ice particle group toward a surface of the mask at a speed of 340 m/s to 1000 m/s, within a cleaning time T, dry ice particles in the dry ice particle group impacting on the surface of the mask. Exemplarily, under continuous impact of the dry ice particles at the speed of 340 m/s to 1000 m/s, an impact strength will not cause damage to the surface of the mask, a surface temperature of the contaminant adhered to the mask is sharply decreased, the surface of the contaminant is embrittled and a crack appears. Next, a part of the dry ice particles which subsequently impact the mask enter the above-described crack, the dry ice particles sublimate into gas rapidly, a volume of the gas is about 700 times an original volume of the dry ice particles, so the gas with a rapidly increased volume can further enlarge the crack, and reduce adhesion of the contaminant; and other part of the dry ice particles further impact the surface of the contaminant, so that the cracked contaminant finally falls off from the surface of the mask, to ultimately achieve an effect of cleaning the mask. By using the above-described method, the tiny and sticky contaminant in a corner or slit can be effectively removed. In addition, the dry ice particles are not corrosive and thus will not corrode the mask; moreover, the dry ice particles after impact will rapidly sublimate into carbon dioxide, and thus a contamination medium will not be generated. Thereby, without increasing the contamination medium and damaging the surface of the mask, the mask cleaning effect can be improved, a production cost is reduced, and industrial pollution is decreased.

Hereinafter, the above-described mask cleaning method will be described in detail.

S101: placing a mask 100 on a stage 20 in a chamber 01.

S102: moving the stage 20 for placing the mask 100 by a conveying device 201, so that the mask 100 is moved to a preset cleaning position. As shown in FIG. 2, the conveying device 201 may be a conveyor belt, and when it rotates in a direction of an arrow, the mask 100 located on the stage 20 is moved to the preset cleaning position.

Therein, the preset cleaning position may be set according to different cleaning modes, which is not limited by an embodiment of the present disclosure. For example, in one embodiment, the preset cleaning position may be set in a center position of the chamber 01. After moving a center position of the mask 100 to the preset cleaning position (the center position of the chamber 01), the conveying device 201 stops moving. The dry ice particles 101 start to clean the mask 100, until the end of the cleaning time T. Then, the conveying device 201 moves the mask 100 out of the chamber 01. The above-described method is simple and easy to implement.

Alternatively, in another embodiment, a preset cleaning position may be further set at a position corresponding to a nozzle 202. The conveying device 201 may, in a speed-variable conveying mode, move a side of the mask 100 which first enters the chamber 01 first at a faster speed to the preset cleaning position. Then, during cleaning, it moves forward at a slower speed, and the dry ice particles 101 start to clean the mask 100 until the end of the cleaning. Thus, respective positions of a to-be-cleaned surface of the mask 100 all pass the above-described preset cleaning position, and are cleaned by the dry ice particles 101 ejected from the nozzle 202. After the cleaning is ended, the conveying device 201 moves the mask 100 out of the chamber 01 at a faster speed again. As a result, by using the above-described cleaning method in the speed-variable conveying mode, although it is relatively complicated to manipulate, yet a time of the cleaning may be saved; and since the respective positions of the to-be-cleaned surface of the mask 100 all pass the above-described preset cleaning position, and are cleaned by the dry ice particles 101 ejected from the nozzle 202, the cleaning effect can be enhanced.

S103: applying gas with a pressure of $1.97\times10^{-3}$ PA to $9.7\times10^{5}$PA to the dry ice particle group, within the cleaning time T, when a density of the dry ice particles 101 in the dry ice particle group is 1.4 g/cm$^3$ to 1.6 g/cm$^3$, so that the dry ice particle group ejected from the nozzle 202 can be ejected toward the surface of the mask 100 at a speed of 340 m/s to 1000 m/s. Further, the dry ice particles 101 in the dry ice particle group clean the contaminant 102 of the surface of the mask 100. Specifically, the above-described gas with the pressure of $1.97\times10^{-3}$ PA to $9.7\times10^{5}$PA may be prepared by a pressure member 212. It should be noted that, the above-described gas may be selected from gas which will not affect physical and chemical properties of the dry ice particle group, the mask 100 and the cleaning apparatus, for example, air, inert gases, and so on.

Therein, within the above-described cleaning time T, when the density of the dry ice particles 101 in the dry ice particle group is 1.4 g/cm$^3$ to 1.6 g/cm$^3$, a feed rate of the dry ice particle group ejected from the nozzle 202 may be set as $6.18\times10^{-9}$ kg/min to 0.6 kg/min. As a result, within the cleaning time T, it is possible to improve a contact probability of the dry ice particles 100 with the contaminant 102, while providing the dry ice particles 101 sufficient to cover the entire mask 100, so as to improve a cleaning efficiency.

S104: blowing air to the surface of the mask 100 impacted by the dry ice particles 101. Exemplarily, air may be input through an air inlet 203 disposed in the chamber 01 (for example, at its top), so as to prevent the contaminant 102 falling off from the surface of the mask 100 from falling down upon the surface of the mask 100 again, under a cleaning action of the dry ice particles 101.

S105: transmitting an ultrasonic wave with a frequency of 1K to 100K Hz to the mask 100, while the dry ice particles 101 are impacting on the mask 100. Since the ultrasonic wave can enable vibration of the cleaned surface of the mask 100, it prevents the contaminant 102 falling off from the surface of the mask 100 from falling down upon the surface of the mask 100 again, wherein, on the one hand, when a frequency of the ultrasonic wave is less than 1K Hz, energy of the ultrasonic wave is smaller, so it is impossible to vibrate the surface of the mask 100; on the other hand, when the frequency of the ultrasonic wave is greater than 100K Hz, the energy of the input ultrasonic wave is too much, so the surface of the mask 100 is vibrated too violently, which may cause deformation of the mask 100. Exemplarily, the ultrasonic wave may be transmitted to the mask 100 by an ultrasonic wave generating source 09.

S106: collecting the contaminant 102 separated from the surface of the mask 100 and carbon dioxide converted from the dry ice particles 101. Exemplarily, collecting may be performed through an air outlet 204 disposed at top of the chamber 01. As a result, the contaminant 102 in a free state in the chamber 01 is cleaned, to prevent it from falling down upon the cleaned surface of the mask 100, resulting in a degraded cleaning effect.

It should be noted that, a sequential order of the above-described step S104 to step S106 is not limited by an embodiment of the present disclosure. Exemplarily, step S104 to step S106 may be performed simultaneously with step S103. Thus, in a procedure of cleaning the mask 100 by using the dry ice particles 101, with the air transported via the air inlet 203 and the ultrasonic wave transmitted to the mask 100 by the above-described ultrasonic wave generating source 09, the contaminant 102 separated from the surface of the mask 100 is taken far away from the surface of the mask 100, to prevent it from falling down upon the cleaned surface of the mask 100 again. In this case, the contaminant 102 in the free state and carbon dioxide converted from the dry ice particles 101 in the chamber 01 are collected through the air outlet 204, to prevent the chamber 01 from being contaminated by the contaminant 102 in the free state, which reduces the cleaning effect on the mask 100. In addition, the number of maintaining the chamber 01 may be reduced, so that costs can be saved.

In addition, those skilled in the art may only perform step S104, or only perform step S105 as actually required.

Figure 4:
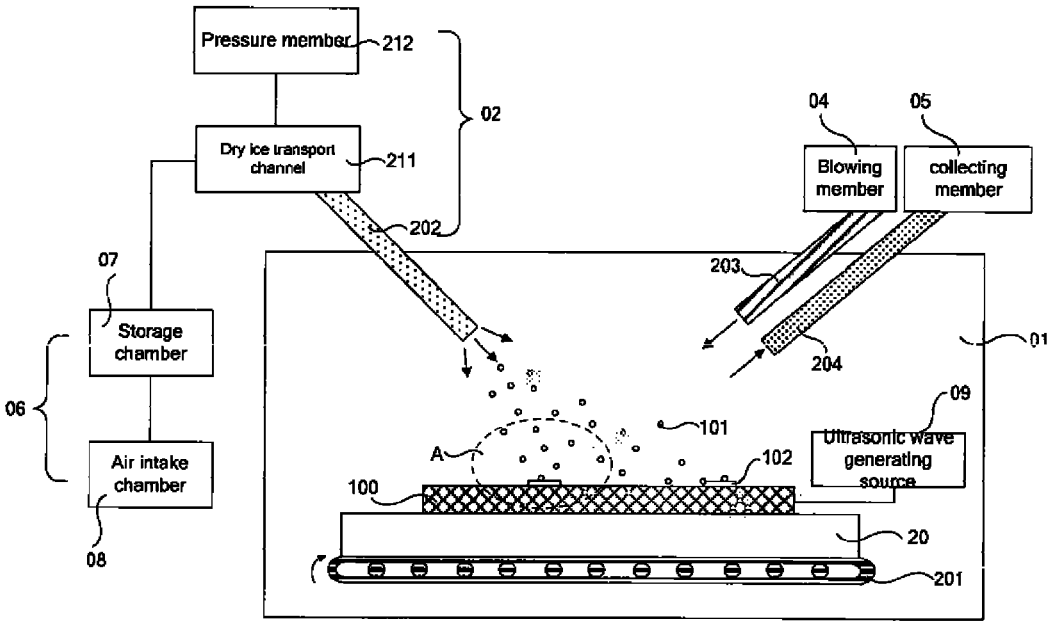
FIG. 4 is a structural schematic diagram of a mask cleaning apparatus provided by an embodiment of the present disclosure.

An embodiment of the present disclosure provides a mask cleaning apparatus, which, as shown in FIG. 4, may comprise: a chamber 01 and a dry ice ejecting device 02.

Therein, the chamber 01 is used for accommodating a mask 100.

The dry ice ejecting device 02 is used for ejecting a dry ice particle group toward the mask 100 at a speed of 340 m/s to 1000 m/s, dry ice particles 101 in the dry ice particle group impact a surface of the mask 100. The dry ice ejecting device 02, connected with a nozzle 202 at top of the chamber 01, is used for providing the dry ice particle group in the dry ice ejecting device 02 to the chamber 01 at an ejecting speed of 340 m/s to 1000 m/s, within a cleaning time T, the dry ice particles 101 in the dry ice particle group impact the surface of the mask 100, wherein, the above-described ejecting speed includes end values 340 m/s and 1000 m/s. On the one hand, when the ejecting speed is less than 340 m/s, since an impact strength is too small, a strength impacting on a contaminant 102 is weak, and after a crack appears in the contaminant 102, the dry ice particles 101 just entering the crack may sublimate into gas, unable to apply an acting force to the crack to enlarge it, so that the contaminant 102 cannot be removed. On the other hand, when the ejecting speed is greater than 1000 m/s, although the impact strength on the contaminant 102 is increased, yet at the same time it will also cause damage to the mask 100.

It should be noted that, firstly, those skilled in the art may set the cleaning time T and a size of the dry ice particle 101, according to a type of the contaminant adhered to the surface of the mask 100. For example, when the contaminant adhered to the mask 100 is a tiny contaminant, the size of the dry ice particle 101 and the cleaning time T may be reduced. When the contaminant 102 has a larger volume and greater stickiness, a volume of the dry ice particles 101 and the cleaning time T may be increased.

Exemplarily, a particle size of the dry ice particle 101 may be 1 μm to 100 μm. On the one hand, when the particle size of the dry ice particle 101 is less than 1 μm, a strength impacting on the contaminant 102 is weak, and an effect of removing the contaminant is not ideal. On the other hand, when the particle size of the dry ice particle 101 is greater than 100 μm, although the strength impacting on the contaminant 102 is increased, yet an effect of removing the contaminant in a slit is not ideal.

Secondly, a feed rate of the dry ice particle group supplied by the dry ice ejecting device 02 to the mask 100 is $6.18\times10^{-9}$ kg/min to 0.6 kg/min. As a result, within the cleaning time T, it is possible to improve a contact probability of the dry ice particles 100 with the contaminant 102, while providing the dry ice particles 101 sufficient to cover the entire mask 100, so as to improve a cleaning efficiency.

Thirdly, the above-described dry ice ejecting device 02 may include: a dry ice transport channel 211, the nozzle 202 and a pressure member 212.

Therein, the dry ice transport channel 211 is used for accommodating the dry ice particle group; wherein, in a case that the particle size of the dry ice particle 101 is 1 μm to 100 μm, a pipe diameter of the dry ice transport channel 211 is 1 mm to 3 mm.

A head of the nozzle 202 is located in the chamber 01, and a connecting portion of the nozzle 202 is connected with the dry ice transport channel 211;

The pressure member 212 is used for supplying gas with a pressure of $1.97\times10^{-3}$ PA to $9.7\times10^{5}$PA to the dry ice transport channel 211 to act on the dry ice particle group comprising dry ice particles 101 with a density of 1.4 g/cm$^3$ to 1.6 g/cm$^3$, so that the dry ice particles 101 may impact the surface of the mask 100 at the speed of 340 m/s to 1000 m/s, and clean the mask 100.

An embodiment of the present disclosure provides a mask cleaning apparatus, which may comprise: a chamber for accommodating a mask and a dry ice ejecting device. The dry ice ejecting device is used for ejecting a dry ice particle group toward the mask at a speed of 340 m/s to 1000 m/s, the dry ice particles in the dry ice particle group impacting on a surface of the mask. Exemplarily, under continuous impact of the dry ice particles at a speed of 340 m/s to 1000 m/s, an impact strength will not cause damage to the surface of the mask, a temperature of the surface of the contaminant adhered to the mask sharply decreases, its surface is embrittled and a crack appears. Next, a part of the dry ice particles which subsequently impact the mask enter the above-described crack, the dry ice particles sublimate into gas rapidly, a volume of the gas is about 700 times an original volume of the dry ice particles, so the gas having rapidly increased volume can further enlarge the crack, and reduce adhesion of the contaminant; and other part of the dry ice particles further impact the surface of the contaminant, so that the cracked contaminant finally falls off from the surface of the mask, to ultimately achieve an effect of cleaning the mask. By using the above-described cleaning apparatus, the tiny and sticky contaminant and the contaminant in a corner or slit can be effectively removed. In addition, the dry ice particles are not corrosive and thus will not corrode the mask; moreover, the dry ice particles after impact will rapidly sublimate into carbon dioxide, and thus a contamination medium will not be generated. Thereby, without increasing the contamination medium and damaging the surface of the mask, the mask cleaning effect can be improved, a production cost is reduced, and industrial pollution is decreased.

In order to better enhance the cleaning effect, the mask cleaning apparatus may further comprise a blowing member 04 and an ultrasonic wave generating source 09.

Exemplarily, the blowing member 04 is connected with an air inlet 203 in the chamber 01 (for example, at its top), and may blow air to the surface of the mask 100, so as to prevent the contaminant 102 falling off from the surface of the mask 100 from falling down upon the surface of the mask 100 again, under a cleaning action of the dry ice particles 101, which results in a reduced cleaning effect.

The ultrasonic wave generating source 09 may transmit an ultrasonic wave with a frequency of 1K to 100K Hz to the mask 100, while the dry ice particles 101 impact the mask 100. Since the ultrasonic wave can enable vibration of the surface of the cleaned mask 100, it prevents the contaminant 102 falling off from the surface of the mask 100 from falling down upon the surface of the mask 100 again, wherein, on the one hand, when a frequency of the ultrasonic wave is less than 1K Hz, energy of the ultrasonic wave is smaller, so it is impossible to vibrate the surface of the mask 100; on the other hand, when the frequency of the ultrasonic wave is greater than 100K Hz, the energy of the input ultrasonic wave is too much, so the surface of the mask 100 is vibrated too violently, which may cause deformation of the mask 100. It should be noted that, the above-described ultrasonic wave generating source 09 may be, as shown in FIG. 4, disposed within the chamber 01, or disposed outside the chamber 01 to transmit the ultrasonic wave to the mask 100 through the air inlet 203, which is not limited by an embodiment of the present disclosure.

In addition, the mask cleaning apparatus may further comprise a collecting member 05 connected with an air outlet 204 in the chamber 01 (for example, at its top), which may collect the contaminant 102 separated from the surface of the mask 100 and carbon dioxide converted from the dry ice particles 101. As a result, the contaminant 102 in a free state in the chamber 01 is cleaned so as to prevent it from falling down upon the cleaned surface of the mask 100, resulting in a reduced cleaning effect. In addition, pollution inside the chamber 01 may also be reduced, and the contaminant 102 in the collecting member 05 may be uniformly disposed, which avoids an adverse effect of the contaminant 102 on the environment.

It should be noted that, within the cleaning time T, the dry ice ejecting device 02 as well as the blowing member 04 and the collecting member 05 as described above may operate simultaneously. Thus, during cleaning the mask 100 by using the dry ice particles 101, the contaminant 102 separated from the surface of the mask 100 may be taken far away from the surface of the mask 100 by using the air input transported by the air inlet 203 and the ultrasonic wave, to prevent it from falling down upon the cleaned surface of the mask 100 again. In this case, the contaminant 102 in the free state and carbon dioxide converted from the dry ice particles 101 in the chamber 01 are collected through the air outlet 204, to prevent the chamber 01 from being contaminated by the contaminant 102 in the free state, which reduces the cleaning effect of the mask 100. In addition, the number of maintaining the chamber 01 may be decreased, so that costs can be saved.

Further, the mask cleaning apparatus may further comprise a stage 20 for loading the mask 100, and a conveying device 201 for moving the stage 20 in the chamber 01.

It should be noted that, the conveying device 201 may be a conveyor belt, and when it rotates in a direction of an arrow, the mask 100 loaded on the stage 20 is moved to a preset cleaning position.

Therein, the preset cleaning position may be set according to different cleaning modes, which is not limited by an embodiment of the present disclosure. For example, the preset cleaning position may be set in a center position of the chamber 01. After moving a center position of the mask 100 to the preset cleaning position (the center position of the chamber 01), the conveying device 201 stops moving. The dry ice particles 101 start to clean the mask 100, until the end of the cleaning time T. Then, the conveying device 201 moves the mask 100 out of the chamber 01. The above-described method is simple and easy to implement.

Alternatively, the preset cleaning position may be set in a position corresponding to a nozzle 202. The conveying device 201 may, in a speed-variable conveying mode, move a side of the mask 100 which first enters the chamber 01 first at a faster speed to the preset cleaning position. Then, during cleaning, it moves forward at a slower speed, and the dry ice particles 101 start to clean the mask 100 until the end of the cleaning. Thus, respective positions of a to-be-cleaned surface of the mask 100 all pass the above-described preset cleaning position, and are cleaned by the dry ice particles 101 ejected from the nozzle 202. After the cleaning is ended, the conveying device 201 moves the mask 100 out of the chamber 01 at a faster speed again. As a result, by using the above-described cleaning method in the speed-variable conveying mode, although it is relatively complicated to manipulate, yet a time of the cleaning may be saved; and since the respective positions of the to-be-cleaned surface of the mask 100 all pass the above-described preset cleaning position, and are cleaned by the dry ice particles 101 ejected from the nozzle 202, the cleaning effect can be enhanced.

Further, in order to improve an automation procedure of a manufacturing process, a dry ice producing device 06 may be disposed in the above-described mask cleaning apparatus. The dry ice producing device 06 may include a storage chamber 07 for storing liquid carbon dioxide and an air intake chamber 08 for supplying compressed air to the storage chamber 07, so that the liquid carbon dioxide is converted to the dry ice particles 101.

Therein, a discharge port of the storage chamber 07 is connected with the dry ice ejecting device 02; and an air inlet port of the storage chamber 07 is connected with the air intake chamber 08.

An exemplary automatic cleaning procedure may be as follows: firstly, the air intake chamber 08 transports the compressed air to the storage chamber 07, and under an action of the compressed air, the liquid carbon dioxide is converted into the dry ice particles 101. Then, the storage chamber 07 transports the dry ice particles 101 to the dry ice ejecting device 02. Next, the dry ice ejecting device 02 ejects the dry ice particle group to the surface of the mask 100 at a speed of 340 m/s to 1000 m/s, and the dry ice particles 101 clean the mask 100. In this cleaning procedure, the blowing member 04 blows air to the mask 100 through the air inlet 203 and an ultrasonic wave with a frequency of 1K to 100K Hz is transmitted to the mask 100 after impact by the dry ice particles 101, to prevent the contaminant 102 falling off from the surface of the mask 100 from falling down upon the surface of the mask 100 again, under a cleaning action of the dry ice particles 101. Meanwhile, the collecting member 05 collects the contaminant 102 separated from the surface of the mask 100 and carbon dioxide converted from the dry ice particles 101 through an air outlet 204. Thereby, the cleaning effect is further enhanced, and pollution inside the chamber 01 is reduced. Thus, in a case that operating parameters of respective devices are set, a whole cleaning procedure does not need manual operation of an operator, and thereby, efficiency of the cleaning procedure can be improved.

The above are only embodiments of the present disclosure, but the scope of the embodiment of the present disclosure is not limited thereto, and any skilled in the art, within the technical scope disclosed by the embodiment of the present disclosure, can easily think of variations or replacements, which should be covered within the protection scope of the embodiment of the present disclosure. Therefore, the scope of the present disclosure should be the scope of the claims.

The present application claims priority of Chinese Patent Application No. 201410817986.1 filed on Dec. 24, 2014, the disclosure of which is incorporated herein by reference in its entirety as part of the present application.

The invention claimed is:

1. A mask cleaning method, comprising:

placing the mask on a stage; and ejecting a dry ice particle group including a plurality of dry ice particles toward a surface of the mask at a speed of 340 m/s to 1000 m/s, within a cleaning time, wherein the plurality of dry ice particles impact the surface of the mask so as to remove a contaminant on the surface of the mask.

2. The mask cleaning method according to claim 1, wherein within the cleaning time, in a case that a density of the dry ice particles in the dry ice particle group is 1.4 g/cm$^3$ to 1.6 g/cm$^3$, a feed rate of the dry ice particle group is $6.18\times10^{-9}$ kg/min to 0.6 kg/min.

3. The mask cleaning method according to claim 1, wherein within the cleaning time, in a case that a density of the dry ice particles in the dry ice particle group is 1.4 g/cm$^3$ to 1.6 g/cm$^3$, a gas with a pressure of $1.97\times10^{-3}$ PA to $9.7\times10^{5}$ PA is supplied to the dry ice particle group, so that the dry ice particle group is ejected toward the surface of the mask at the speed of 340 m/s to 1000 m/s.

4. The mask cleaning method according to claim 1, after ejecting the dry ice particle group including the plurality of dry ice particles toward the surface of the mask at the speed of 340 m/s to 1000 m/s, further comprising: collecting the contaminant separated from the surface of the mask and carbon dioxide converted from the dry ice particles.

5. The mask cleaning method according to claim 1, after ejecting the dry ice particle group including the plurality of dry ice particles toward the surface of the mask at the speed of 340 m/s to 1000 m/s and before collecting the contaminant separated from the surface of the mask and carbon dioxide converted from the dry ice particles, further comprising:

blowing air to the surface of the mask impacted by the dry ice particles; and/or, transmitting an ultrasonic wave with a frequency of 1K Hz to 100K Hz to the mask, while blowing air to the surface of the mask.

6. The mask cleaning method according to claim 1, while ejecting the dry ice particle group including the plurality of dry ice particles toward the surface of the mask at the speed of 340 m/s to 1000 m/s, further comprising:

blowing air to the surface of the mask; and/or, transmitting an ultrasonic wave with a frequency of 1K Hz to 100K Hz to the mask, while blowing air to the surface of the mask.

7. The mask cleaning method according to claim 6, while ejecting the dry ice particle group including the plurality of dry ice particles toward the surface of the mask at the speed of 340 m/s to 1000 m/s, further comprising:

collecting the contaminant separated from the surface of the mask and carbon dioxide converted from the dry ice particles.

8. The mask cleaning method according to claim 1, wherein a particle size of the dry ice particle is 1 μm to 100 μm.

9. The mask cleaning method according to claim 1, wherein while ejecting the dry ice particle group including the plurality of dry ice particles toward the surface of the mask at the speed of 340 m/s to 1000 m/s, the mask is fixed and stationary.

10. The mask cleaning method according to claim 1, wherein, while ejecting the dry ice particle group including the plurality of dry ice particles toward the surface of the mask at the speed of 340 m/s to 1000 m/s, the mask is moved.

11. A mask cleaning apparatus, comprising:

a chamber, configured to accommodate a mask; and a dry ice ejecting device, configured to eject a dry ice particle group including a plurality of dry ice particles toward the mask at a speed of 340 m/s to 1000 m/s, wherein the dry ice particles impact a surface of the mask so as to remove a contaminant on the surface of the mask.

12. The mask cleaning apparatus according to claim 11, wherein the dry ice ejecting device comprises:

a dry ice transport channel, configured to accommodate the dry ice particle group;

a nozzle, a head of the nozzle being located in the chamber, and a connecting portion of the nozzle being connected with the dry ice transport channel; and a pressure member, configured to supply a gas with a pressure of $1.97\times10^{-3}$ PA to $9.7\times10^{5}$ PA to the dry ice transport channel to act on the dry ice particle group comprising the dry ice particles with a density of 1.4 g/cm$^3$ to 1.6 g/cm$^3$.

13. The mask cleaning apparatus according to claim 12, wherein in a case that a particle size of the dry ice particle is 1 μm to 100 μm, a pipe diameter of the dry ice transport channel is 1 mm to 3 mm.

14. The mask cleaning apparatus according to claim 11, wherein a feed rate of the dry ice particle group supplied by the dry ice ejecting device to the mask is $6.18\times10^{-9}$ kg/min to 0.6 kg/min, and a density of the dry ice particles in the dry ice particle group is 1.4 g/cm$^3$ to 1.6 g/cm$^3$.

15. The mask cleaning apparatus according to claim 11, further comprising:

a collecting member, connected with an air outlet of the chamber and configured to collect the contaminant separated from the surface of the mask and carbon dioxide converted from the dry ice particles.

16. The mask cleaning apparatus according to claim 11, further comprising: a blowing member and an ultrasonic wave generating source, wherein the blowing member is connected with an air inlet of the chamber and is used for blowing air to the surface of the mask; and/or the ultrasonic wave generating source is used for transmitting an ultrasonic wave with a frequency of 1K Hz to 100K Hz to the mask, while the dry ice particles impact the mask.

17. The mask cleaning apparatus according to claim 11, further comprising: a dry ice producing device, communicated with the dry ice ejecting device, and configured to supply the dry ice particles to the dry ice ejecting device.

18. The mask cleaning apparatus according to claim 17, wherein the dry ice producing device comprises:

a storage chamber, configured to store liquid carbon dioxide; and an air intake chamber, configured to supply compressed air to the storage chamber, so that the liquid carbon dioxide is converted to the dry ice particles, wherein a discharge port of the storage chamber is connected with the dry ice ejecting device, and an air inlet port of the storage chamber is connected with the air intake chamber.

19. The mask cleaning apparatus according to claim 11, wherein the chamber is provided with a stage on which the mask is placed.

20. The mask cleaning apparatus according to claim 11 wherein the chamber is further provided with a conveying device, the conveying device being configured to move the stage.

* * * * *